US010687647B2

(12) United States Patent
Baun

(10) Patent No.: US 10,687,647 B2
(45) Date of Patent: Jun. 23, 2020

(54) PIVOTING PLATFORM FOR A MAILBOX

(71) Applicant: Kurtis Baun, Fountain Inn, SC (US)

(72) Inventor: Kurtis Baun, Fountain Inn, SC (US)

( * ) Notice: Subject to any disclaimer, the term of this patent is extended or adjusted under 35 U.S.C. 154(b) by 0 days.

(21) Appl. No.: 16/183,061

(22) Filed: Nov. 7, 2018

(65) Prior Publication Data

US 2019/0133361 A1 May 9, 2019

Related U.S. Application Data

(60) Provisional application No. 62/582,413, filed on Nov. 7, 2017.

(51) Int. Cl.
*A47G 29/12* (2006.01)
*A47G 29/14* (2006.01)

(52) U.S. Cl.
CPC ..... *A47G 29/1216* (2013.01); *A47G 29/12* (2013.01); *A47G 29/1209* (2013.01); *A47G 29/12095* (2017.08); *A47G 29/12097* (2017.08); *A47G 2029/148* (2013.01)

(58) Field of Classification Search
CPC ..... A47G 29/12; A47G 29/1209; A47G 29/12097; A47G 29/12095; A47G 2029/148
See application file for complete search history.

(56) References Cited

U.S. PATENT DOCUMENTS 908,543 A * 1/1909 Brown ..... A47G 29/121 232/34
1,204,494 A * 11/1916 Sare ..... A47G 29/1209 232/45
1,810,769 A * 6/1931 Jaden ..... A47G 29/12 232/28
1,990,333 A * 2/1935 Knickerbocker .. A47G 29/1209 248/134
2,192,445 A * 3/1940 Lau ..... A47G 29/1209 232/17
2,420,699 A * 5/1947 Cox ..... A47G 29/1209 232/17
2,551,213 A * 5/1951 Lang ..... B42F 17/00 40/389
2,827,228 A * 3/1958 Wikert ..... A47G 29/121 232/35
2,868,444 A * 1/1959 Whittier ..... A47G 29/1209 232/45
3,216,583 A * 11/1965 Vani ..... B42F 17/08 211/51
4,160,520 A * 7/1979 Cluthe ..... A47G 29/1209 232/17
4,508,259 A * 4/1985 Hicks ..... A47G 29/1209 232/17
4,932,587 A 6/1990 Robbins
5,029,783 A * 7/1991 Alvarez ..... A47G 29/1216 232/39
5,042,716 A * 8/1991 Robbins ..... A47G 29/1216 232/39

(Continued)

*Primary Examiner* — Eret C McNichols

(74) *Attorney, Agent, or Firm* — J. Bennett Mullinax, LLC

(57) ABSTRACT

This invention provides a support platform for securing the base of a mailbox to a post or other horizontal support member. More particularly, the invention is directed to a mailbox and a support for a base of a mailbox in which the mailbox is able to pivot from a substantially horizontal position to an inclined position.

7 Claims, 4 Drawing Sheets

(56) References Cited

U.S. PATENT DOCUMENTS

| | | | | |
|---|---|---|---|---|
| 5,117,928 | A * | 6/1992 | Weihe | B07C 9/00 177/50 |
| 5,460,325 | A * | 10/1995 | Surman | A47G 29/1209 232/17 |
| 7,032,811 | B1 * | 4/2006 | Paulic | A47G 29/1216 232/39 |
| 7,172,165 | B1 * | 2/2007 | Young | A45D 29/20 211/10 |
| 7,195,146 | B1 * | 3/2007 | Dunn | A47G 29/1216 232/39 |
| 7,527,190 | B1 | 5/2009 | Bowers | |
| 7,533,796 | B1 * | 5/2009 | Catropa | A47G 29/1209 232/17 |
| 2004/0211827 | A1 * | 10/2004 | Gunvaldson | A47G 29/1209 232/19 |
| 2005/0121503 | A1 * | 6/2005 | Billings | A47G 29/1209 232/29 |
| 2005/0258227 | A1 * | 11/2005 | Flores | A47G 29/1209 232/29 |
| 2006/0081694 | A1 * | 4/2006 | Campbell | A47G 29/1209 232/29 |
| 2008/0206031 | A1 * | 8/2008 | Butta | B60R 9/06 414/462 |
| 2010/0116875 | A1 * | 5/2010 | Do | A47G 29/1209 232/17 |
| 2011/0210166 | A1 * | 9/2011 | Dinh | A47G 29/1209 232/17 |
| 2013/0020384 | A1 * | 1/2013 | Corey | A47G 29/1209 232/17 |
| 2019/0313827 | A1 * | 10/2019 | Tricarico | A47G 29/1209 |

* cited by examiner

PIVOTING PLATFORM FOR A MAILBOX

RELATED APPLICATIONS

This application claims the benefit of U.S. Application Ser. No. 62/582,413 filed on Nov. 7, 2018 and which is incorporated herein by reference.

FIELD OF THE INVENTION

This invention is directed towards support platforms for securing the base of a mailbox to a post or other horizontal support member. More particularly, the invention is directed to a support for a base of a mailbox in which the mailbox is able to pivot from a substantially horizontal position to an inclined position.

BACKGROUND OF THE INVENTION

It is known in the art to provide for a mailbox which can be positioned and moved to make retrieval of the mail easier. One such mailbox is seen in reference to U.S. Pat. No. 4,932,587 and which is incorporated herein by reference. However, there remains room for improvement and variation with the art.

SUMMARY OF THE INVENTION

It is one aspect of one of the present embodiments to a support for a base of a mailbox comprising and/or consisting of:

a first platform for placement within a recessed base defined by a mailbox;

a second platform for placement below the first platform;

a hinge connecting the first platform to the second platform, a first edge of the spring hinge secured to a recessed thickness region defined by a terminal end of the first platform and a second end of the spring hinge secured to a reduced thickness region defined by a terminal end of the second platform;

wherein the hinge allows for pivoted movement of the mailbox when secured to the first platform and which moves relative to a fixed position of the second platform.

It is a further aspect of at least one embodiment of the invention to provide a support for a mailbox base as described above wherein the first platform and the second platform are provided by a molded plastic.

It is a further aspect of at least one embodiment of the invention to provide a support for a mailbox base as described above wherein the first platform and the second platform are provided by wood.

It is a further aspect of at least one embodiment of the invention to provide a support for a mailbox base as described above wherein the first platform and the second platform are maintained in a substantially flush position by the tension within the spring hinge.

It is a further aspect of at least one embodiment of the invention to provide a support for a mailbox base as described above wherein the spring hinge is a door hinge.

It is a further aspect of at least one embodiment of the invention to provide a support for a mailbox base as described above wherein a support for a base of a mailbox comprising:

a first platform for placement within a recessed base defined by a mailbox;

a second platform for placement below the first platform;

a spring hinge connecting the first platform to the second platform, a first edge of the spring hinge secured to a recessed thickness lip defined by a terminal end of the first platform and a second end of the spring hinge secured to a reduced thickness lip defined by a terminal end of the second platform;

the first platform defining a first edge, the first edge in communication with a side portion of a central panel along a first rail and a second rail, each of the first rail and second rail being extendable in a lateral direction from openings defined by the central panel;

the first panel defining a second edge, the second edge in communication with a side portion of a central panel via a third rail and a fourth rail, each of the third and fourth rails being extendable in a lateral direction from openings defined by the central panel;

wherein the spring hinge allows for a method for the pivoted movement of the mailbox secured to the first platform which tilts the mailbox in a forward direction toward the front of the mailbox.

It is a further aspect of at least one embodiment of the invention to provide a mailbox and a method of using the mailbox comprising:

a hinged door;

a rear wall opposite the hinged door;

a pair of opposing side walls extending from the hinged door to the rear wall;

a top wall connected to a corresponding portion of an upper edge of the side wall;

a bottom wall connected to a corner portion of a lower edge of the side walls, the bottom wall defining a recessed space between a lower surface of the bottom wall and a lower edge of the pair of opposing side walls;

a support positioned within the recess of the base, the support for the comprising a first platform for placement within a recessed base defined by a mailbox;

a second platform for placement below the first platform;

a spring hinge connecting the first platform to the second platform, a first edge of the spring hinge secured to a recessed thickness lip defined by a terminal end of the first platform and a second end of the spring hinge secured to a reduced thickness lip defined by a terminal end of the second platform;

wherein the spring hinge allows for pivoted movement of the mailbox secured to the first platform which moves relative to a fixed position of the second platform.

It is a further aspect of at least one embodiment of the invention to provide a support for a mailbox base as described above wherein the mailbox support has a handle which extends from an edge of the first platform and is adapted for an individual to pivot the mailbox along the hinge when the platform is positioned within the base of a mailbox.

It is a further aspect of at least one embodiment of the invention to provide a support for a mailbox base as described above wherein the mailbox handle extends from an edge of the platform and provide one of the side walls of the mailbox, the handle adapted for an individual to pivot the mailbox along the spring hinge.

These and other features, aspects, and advantages of the present invention will become better understood with reference to the following description and appended claims.

BRIEF DESCRIPTION OF THE DRAWINGS

A fully enabling disclosure of the present invention, including the best mode thereof to one of ordinary skill in the art, is set forth more particularly in the remainder of the specification, including reference to the accompanying drawings.

DESCRIPTION OF THE PREFERRED EMBODIMENT

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

In describing the various figures herein, the same reference numbers are used throughout to describe the same material, apparatus, or process pathway. To avoid redundancy, detailed descriptions of much of the apparatus once described in relation to a figure is not repeated in the descriptions of subsequent figures, although such apparatus or process is labeled with the same reference numbers.

Figure 1:
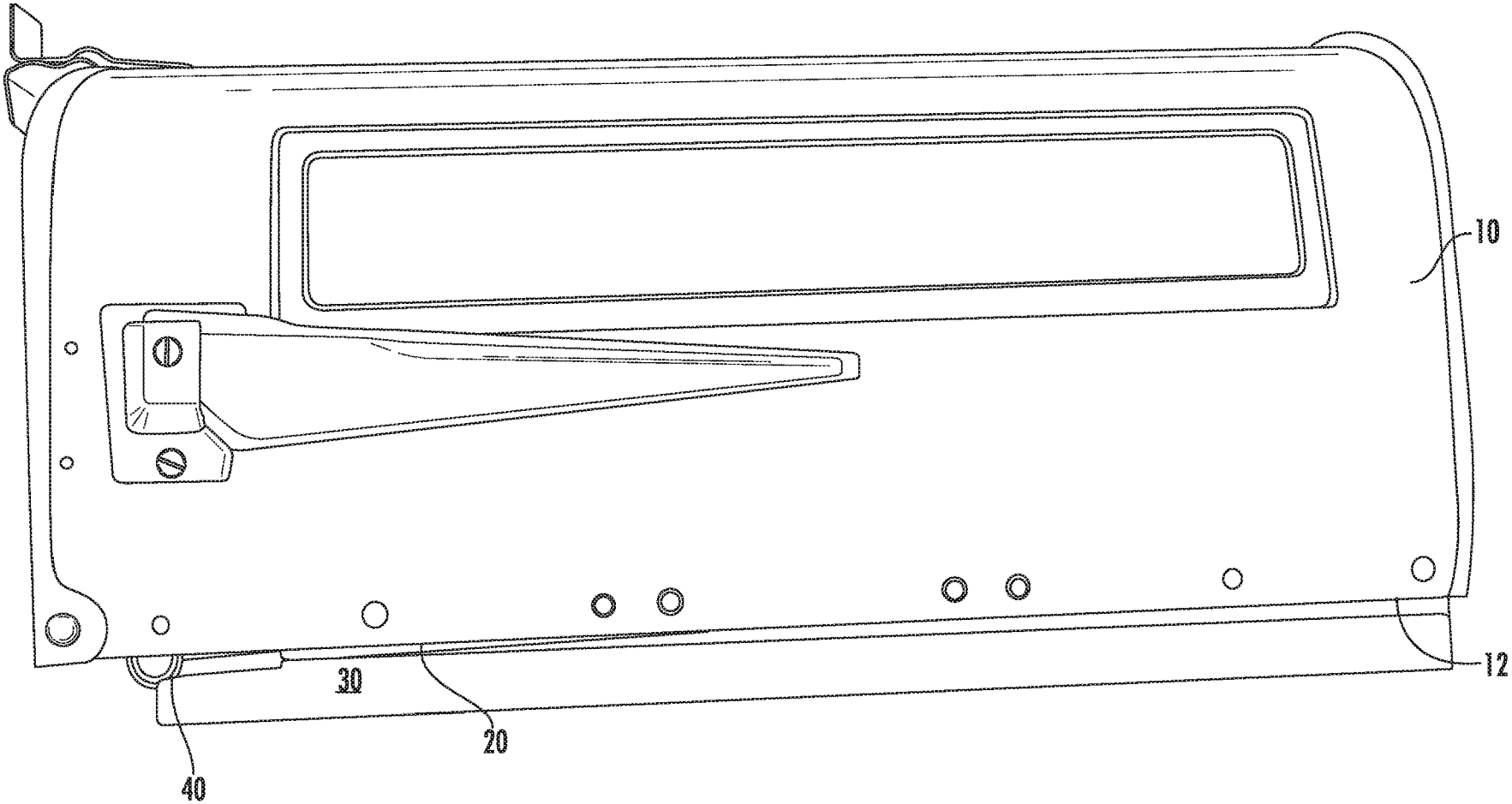
FIG. 1 is a side view of a conventional mailbox showing installation of a support structure within the base of the mailbox and in accordance with the present invention.

Set forth in FIG. 1 is a side view of a conventional mailbox. Mailbox 10 can be any number of the standard postal approved sizes and configurations such as set forth in U.S. Pat. No. 7,527,190 and which is incorporated herein by reference. A typical construction for a mailbox 10 includes having a recessed base 12 which is adapted for receiving a fitted base member which is secured to the mailbox and with the base member in turn being secured to a mailbox post or other support.

As seen in reference to FIG. 1, the recessed base 12 of mailbox 10 has inserted therein a first platform 20 which is secured to the base through conventional fasteners such as screws which attach from a side of the mailbox into a side of the first platform. Beneath the first platform 20 is a second platform 30 which is connected to the first platform 20 by a hinge 40 as best seen in reference to FIGS. 2 and 3. Hinge 40 has a first edge 42 and a second edge 44 which are attached to respective counter sunk portions 22 and 32 of the respective first platform 20 and second platform 30. The counter sunk portions 22 and 32 provide for flush placement of the hinge edges 42 and 44 such that the opposing surfaces of the first platform 20 and the second platform 30 can be maintained in a flush and adjacent orientation.

While the exemplary embodiment of the support unit illustrated in FIG. 1 has the first platform 20 substantially residing within the recessed base 12, variations on the spaced relationship between the respective first platform 20 and 30 and the recessed base 12 are possible. For instance, the first platform 20 could be contained entirely within the recessed base 12 or could extend partially below the recessed box mailbox 10.

When the first platform 20 is secured within the recessed base 12 of mailbox 10 and the second platform is operatively engaged with the first platform through the attachment of hinge 40, it is possible to tilt the mailbox from a substantially horizontal position to an inclined position. In a preferred embodiment, the hinge pin is located towards the front entrance of the mailbox so as to allow the rear end of the mailbox to be elevated and pivoted away from the horizontal support. In this manner, mail and other contents of the mailbox will slide toward the front of the mailbox and be easier to remove.

Some mailbox configurations have dual doors on both the front and back of the mailbox and accordingly the orientation of the hinge could be positioned such that the pivot point is carried along the rear of the mailbox for mailboxes where a rear door is designed for removing mail. The hinge could be placed along any edge of the support platform.

In the illustrated embodiment, hinge 40 can be provided by a spring-loaded door hinge which provides for a substantial closing force that will keep the two edges 42 and 44 of the hinge in a flush arrangement. When the hinge is pivoted by lifting one end of the mailbox, the spring tension is sufficient to return the mailbox to the substantially horizontal position when the lifting pressure is removed. Hinge 40 can be provided from any number of know hinges within the art. In additional to a spring-loaded door hinge, a customized hinge can be utilized as well as using two or more smaller hinges. While not preferred, non-spring-loaded hinges, such as a non-spring door hinge or piano hinge, could be utilized where the weight of the mailbox is sufficient to maintain the mailbox in a substantially horizontal orientation during times of high wind.

The first platform and or the second platform can be provided with any number of substrates including wood, molded plastic, metals, and other materials that are suitable for forming the platforms. While it is envisioned that the first platform and second platform are formed of the same materials, it is possible that different materials are utilized such that the first platform is of wood and a second platform is of a plastic or resin material. The ability to easily tilt the mailbox has advantages, particularly, in more rural areas where there may be some distance between a business or residence and the location of the mailbox along a surface street. Frequently, an individual may check the mailbox from the inside of a vehicle and the ability to tilt the box toward the individual makes it easier to retrieve all the mail.

Figure 2:
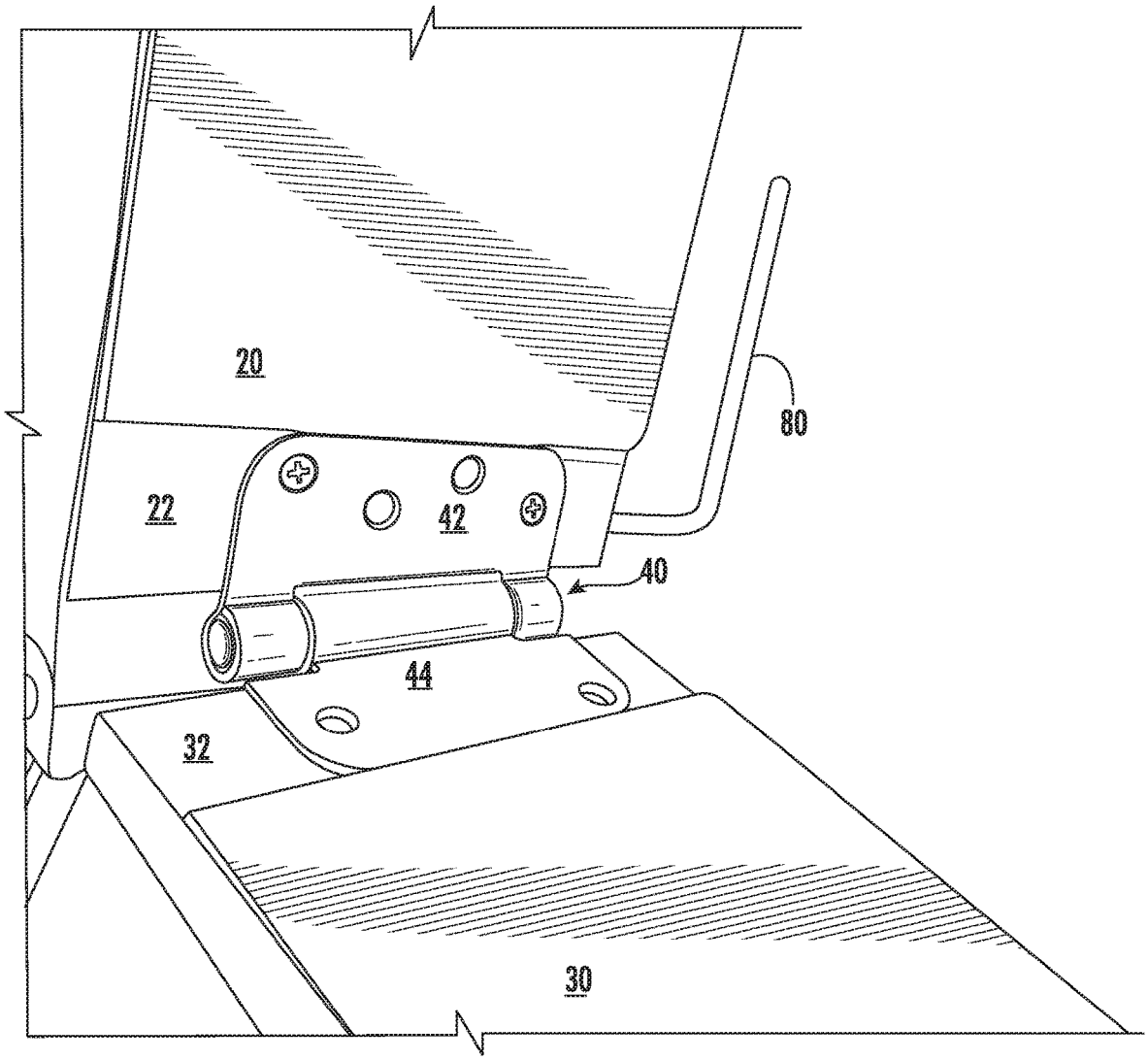
FIG. 2 shows a spring hinge placed between a first support platform and a second support platform which collectively are used to support a mailbox such that the mailbox can be moved from a horizontal position to a temporary non-horizontal position.

As best seen in FIG. 2, one edge of the upper platform can have a L-shaped handle 80 extending from the edge of the platform and near hinge 40. The handle is a spaced distance from the mailbox and allows a user to grab the handle to pivot the mailbox in a forward direction such that the rear of the mailbox is elevated above a reference plane relative to the front of the mailbox. This allows for the contents of the mailbox to move toward the front of the mailbox and in proximity to the door such that the mail can be more easily collected.

Figure 3:
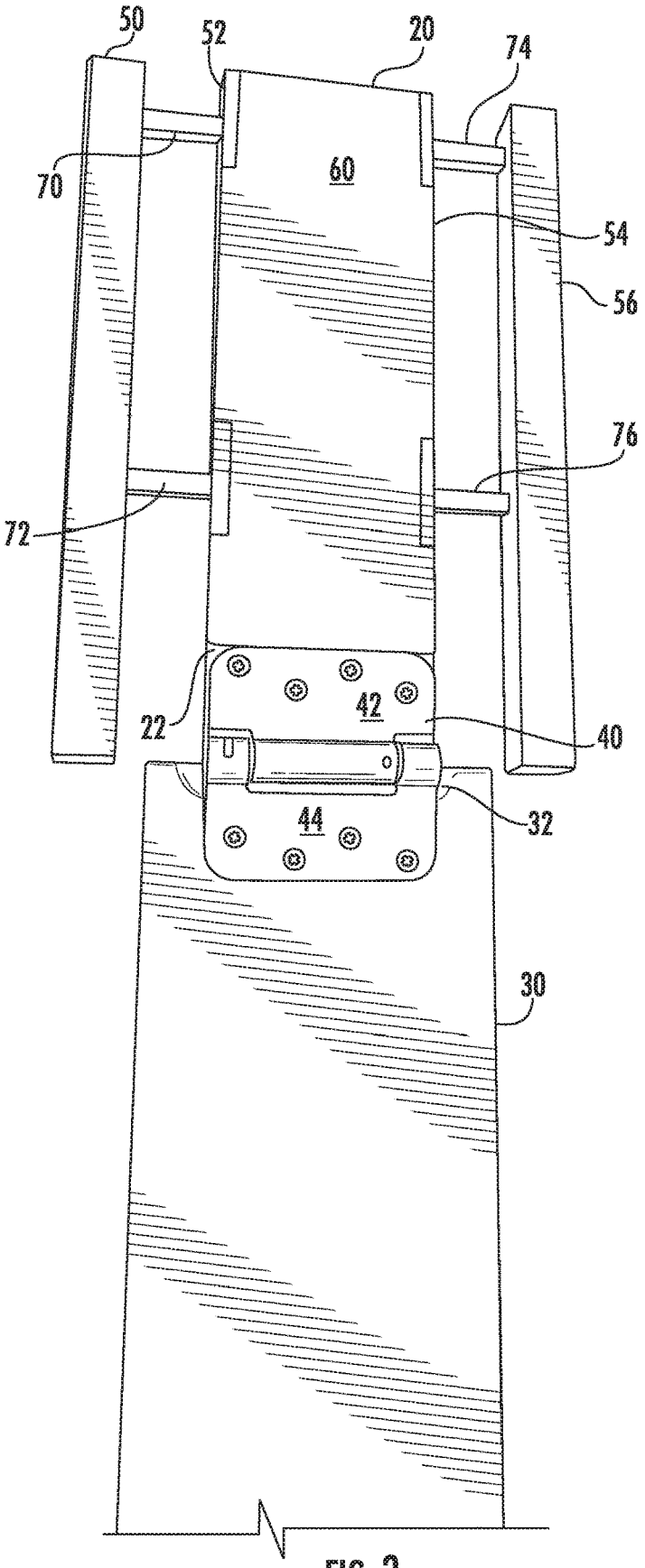
FIG. 3 is a close up of the spring hinge attached to the relative portions of the support platform and showing optional slides for size adjustment.
Figure 4:
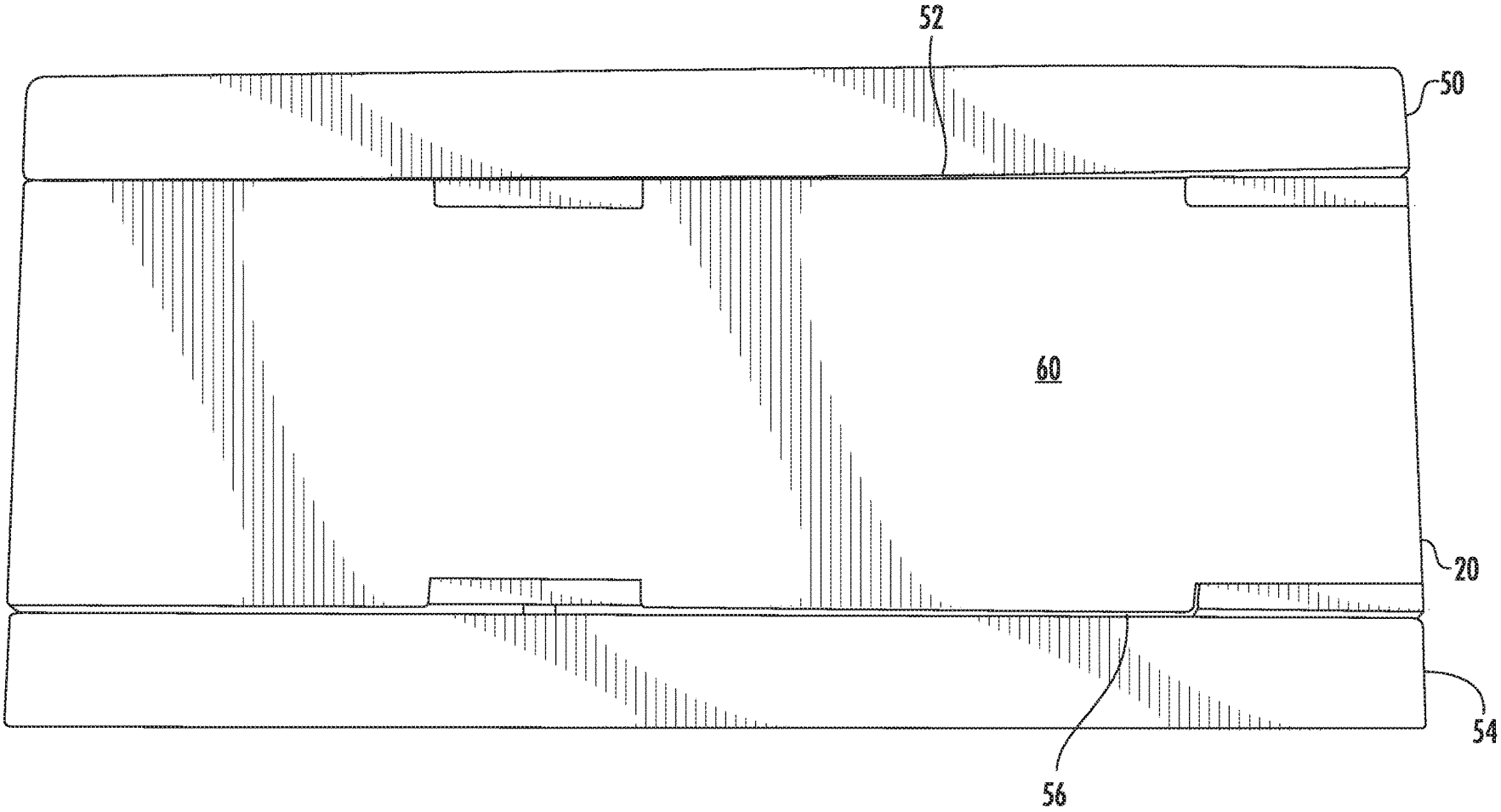
FIG. 4 is a view similar to FIG. 3 which the optional slides in a non-extended configuration.

As seen in the alternative embodiment of FIGS. 3 and 4, the upper platform 20 defines a first edge 50, the first edge 50 in sliding communication with a side portion 52 of a central panel 60 along a first rail 70 and a second rail 72, each of the first rail 70 and second rail 72 being extendable in the lateral direction from openings defined by the central panel 60.

The first panel further defines a second edge, the second edge 54 in communication with a side second portion 56 of a central panel 60 via a third rail 74 and a fourth rail 76, each of the third and fourth rails 74 and 76 being extendable in a lateral direction from openings defined by the central panel 60. While the rails set forth in the illustration are square, any shape rail including circular rails, or any suitable polygonal shape can be utilized with the rails. The rails allow the first edge and/or the second edge to be extended in a lateral direction so as to allow for a customized fit within a recess defined by a bottom of a conventional mailbox.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention. In addition, it should be understood that aspects of the various embodiments may be interchanged, both in whole, or in part. Therefore, the spirit and scope of the invention should not be limited to the description of the preferred versions contained therein.

The invention claimed is:

1. A support for a base of a mailbox comprising:

a first platform for placement within a recessed base defined by a mailbox;

a second platform for placement below the first platform;

a hinge connecting the first platform to the second platform, a first edge of the hinge secured to a recessed thickness lip defined by a terminal end of the first platform and a second end of the hinge secured to a reduced thickness lip defined by a terminal end of the second platform;

the first platform defining a first edge, the first edge in communication with a side portion of a central panel along a first rail and a second rail, each of the first rail and second rail being extendable in a lateral direction from openings defined by the central panel;

the first panel defining a second edge, the second edge in, communication with a side portion of a central panel via a third rail and a fourth rail, each of the third and fourth rails being extendable in a lateral direction from openings defined by the central panel;

wherein the hinge allows for pivoted movement of the mailbox secured to the first platform which moves relative to a fixed position of the second platform.

2. The support according to claim 1 wherein the first platform and the second platform are provided by a molded plastic.

3. The support according to claim 1 wherein the first platform and the second platform are provided by wood.

4. The support according to claim 1 wherein the first platform and the second platform are maintained in a substantially flush position by the tension within the spring hinge.

5. The support according to claim 1 wherein the hinge is a spring door hinge.

6. The support for a base of a mailbox according to claim 1 wherein a handle extends from an edge of the first platform and is adapted for an individual to pivot the mailbox along the hinge when the platform is positioned within the base of a mailbox.

7. The support for a base of a mailbox according to claim 1 wherein a handle extends from an edge of the platform and one of the side walls of the mailbox, the handle adapted for an individual to pivot the mailbox along the spring hinge.

* * * * *